US010889972B2

(12) United States Patent
Wu et al.

(10) Patent No.: US 10,889,972 B2
(45) Date of Patent: Jan. 12, 2021

(54) BRACKET FOR HAND SHOWER

(71) Applicant: Purity (Xiamen) Sanitary Ware Co., Ltd., Xiamen (CN)

(72) Inventors: James Wu, Taichung (TW); Alex Wu, Taichung (TW); Ce-Wen Yang, Xiamen (CN)

(73) Assignee: PURITY (XIAMEN) SANITARY WARE CO., LTD., Xiamen (CN)

( * ) Notice: Subject to any disclaimer, the term of this patent is extended or adjusted under 35 U.S.C. 154(b) by 6 days.

(21) Appl. No.: 16/432,550

(22) Filed: Jun. 5, 2019

(65) Prior Publication Data

US 2020/0385968 A1 Dec. 10, 2020

(51) Int. Cl.
*E03C 1/06* (2006.01)
*F16M 13/02* (2006.01)

(52) U.S. Cl.
CPC ..... *E03C 1/06* (2013.01)

(58) Field of Classification Search
USPC ..... 4/695; 248/200; 285/46, 64
See application file for complete search history.

(56) References Cited

U.S. PATENT DOCUMENTS

2007/0272770 A1* 11/2007 Leber ..... B05B 15/654 239/451
2009/0007330 A1* 1/2009 Genord ..... B05B 15/62 4/695
2009/0289129 A1* 11/2009 Qiu ..... E03C 1/06 239/550
2010/0103646 A1* 4/2010 Coushaine ..... F21L 13/02 362/96
2013/0340854 A1* 12/2013 Quinn ..... E03C 1/025 137/343

* cited by examiner

*Primary Examiner* — Lori L Baker
(74) *Attorney, Agent, or Firm* — Birch, Stewart, Kolasch & Birch, LLP

(57) ABSTRACT

A bracket for a hand shower includes a pipe and a bracket assembly, wherein the bracket assembly is connected to the pipe. The bracket assembly includes a main body and a flexible member. The main body includes a first arm and a second arm, both of the first arm and the second arm have a pivoted end, the first arm is connected to the second arm, and the pivoted end of the first arm is separated from the pivoted end of the second arm, so as to compose a recess. The flexible member includes a girdle portion, a first pivoting portion and a second pivoting portion, wherein one end of the girdle portion is connected to the first pivoting portion, and another end of the girdle portion is connected to the second pivoting portion. The first pivoting portion of the flexible member is pivotably connected to the pivoted end of the first arm, and the second pivoting portion of the flexible member is pivotably connected to the pivoted end of the second arm.

16 Claims, 11 Drawing Sheets

BRACKET FOR HAND SHOWER

BACKGROUND OF THE INVENTION

1. Technical Field

The present invention relates generally to bracket for hand shower.

2. Description of Related Art

In modern life, bathing and showering have become routine affairs. For modern life is busy and compact, and it needs to save water, people mostly take showers to solve the need for cleaning their body. The showering facilities mainly includes a shower head and a hand shower, wherein the hand shower has a handle for holding by a user to washing his body; the shower head is usually mounted on a wall or a top of a vertical post, and the user can stand under the shower head to wash his head.

A conventional hand shower of the showering facilities is usually equipped with a holder which is independently mounted on a wall or a vertical post. When a user has used the hand shower, the user puts the hand shower on the holder. However, the conventional holder is made of metal or plastic, which makes the conventional holder has a rigid structure and has only a single size. In general, the conventional holder corresponds to the handle size of a particular type of hand showers. Therefore, when the hand shower is replaced, the new hand shower may not be put into the original holder, so that the user must find a new holder at the same time to match the size of the new hand shower, whereby to increase the purchase cost. On the other hand, since the new hand shower cannot be put into the original holder, the original holder needs to be removed and discarded, resulting in waste of intact equipments.

On the other hand, in the case of the conventional holder, when a user has used the hand shower, who needs to raise the hand shower, put the connecting tube into a gap of the conventional holder first, and then downwardly put the handle of the hand shower into the conventional holder. Accordingly, the conventional holder is not convenient to use.

At least for the above reasons, the conventional showers still have room for improvements.

BRIEF SUMMARY OF THE INVENTION

In view of the above, the primary objective of the present invention is to provide a bracket for a hand shower. Compared to the conventional holder, the bracket provided in the present invention is convenient to use, and is adapted to hold various sizes of hand showers.

The present invention provides a bracket for a hand shower including a pipe and a bracket assembly. The pipe includes a pipe body, an inlet opening and an outlet opening, wherein the inlet opening is at one end of the pipe body, and the outlet opening is at another end of the pipe body, the inlet opening and the outlet opening communicate with each other. The bracket assembly is connected to the pipe body of the pipe, and includes a main body and a flexible member. The main body includes a first arm and a second arm. Both of the first arm and the second arm have a connected end and a pivoted end, wherein the connected end of the first arm is connected to the connected end of the second arm, and the pivoted end of the first arm is separated from the pivoted end of the second arm, so as to compose a recess. The flexible member includes a girdle portion, a first pivoting portion and a second pivoting portion, wherein one end of the girdle portion is connected to the first pivoting portion, and another end of the girdle portion is connected to the second pivoting portion. The first pivoting portion of the flexible member is pivotably connected to the pivoted end of the first arm, while the second pivoting portion of the flexible member is pivotably connected to the pivoted end of the second arm. When the hand shower is positioned on the bracket, one part of the hand shower is girdled by the girdle portion of the flexible member, and the first pivoting portion and the second pivoting portion of the flexible member are pivoted toward the recess, whereby to move the hand shower toward the recess, so that the hand shower is girdled by the bracket assembly. When the hand shower is moved away from the bracket, the hand shower is moved away from the recess, whereby to pivot the first pivoting portion and the second pivoting portion of the flexible member away from the recess, so that the hand shower is not girdled by the girdle portion of the flexible member.

With the aforementioned design, since a hand shower could be taken from and put into the bracket in a forward direction or a backward direction, the bracket provided in the present invention is more convenient to use. Furthermore, the bracket provided in the present is adapted to hold various sizes of hand showers, for the bracket includes the girdle portion of the flexible member, which could be adapted to girdled a handle of the hand shower, when the hand shower is positioned on the bracket.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
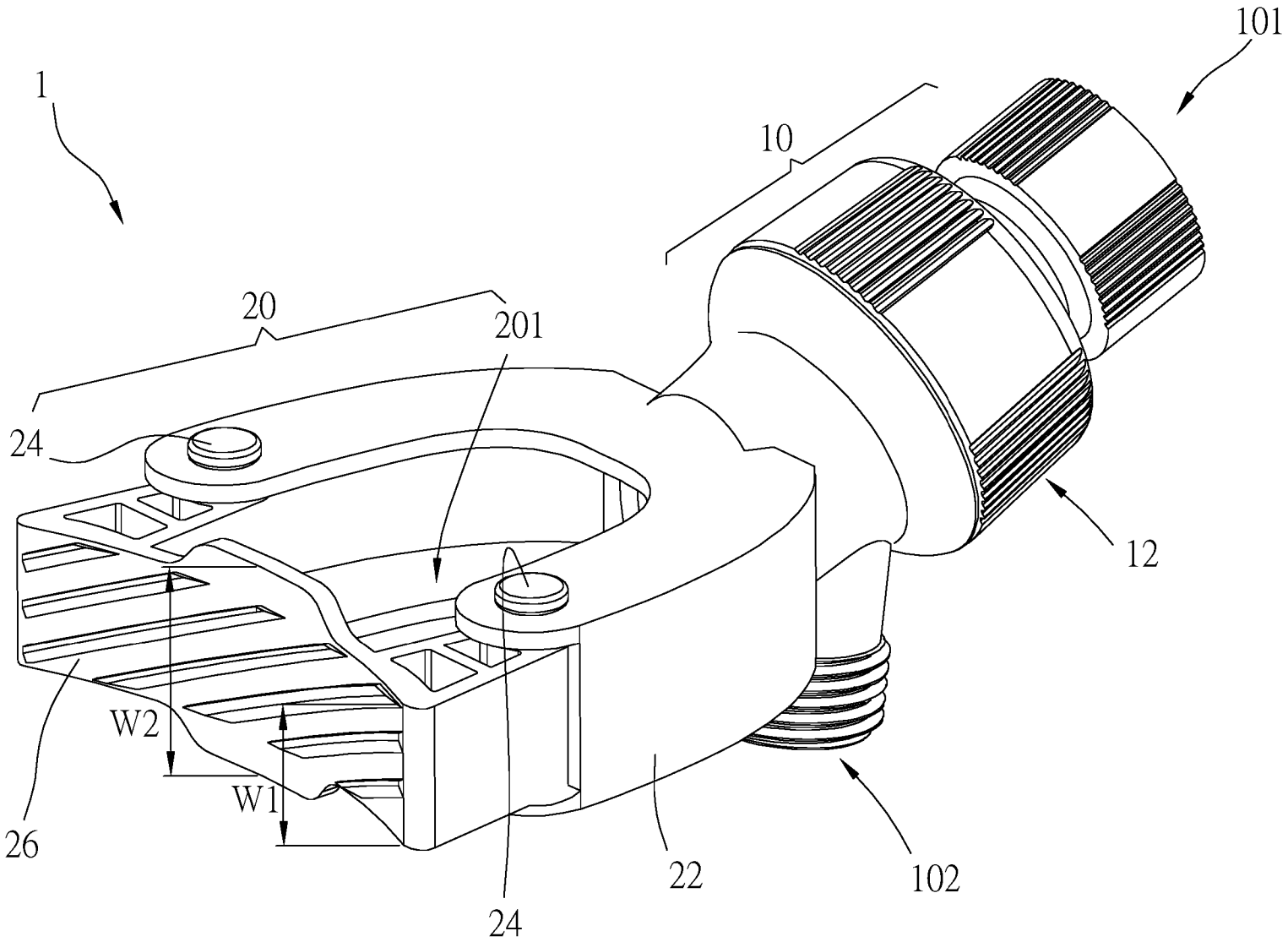
FIG. 1 is a perspective view of a bracket for a hand shower according to one embodiment of the present invention.
Figure 2:
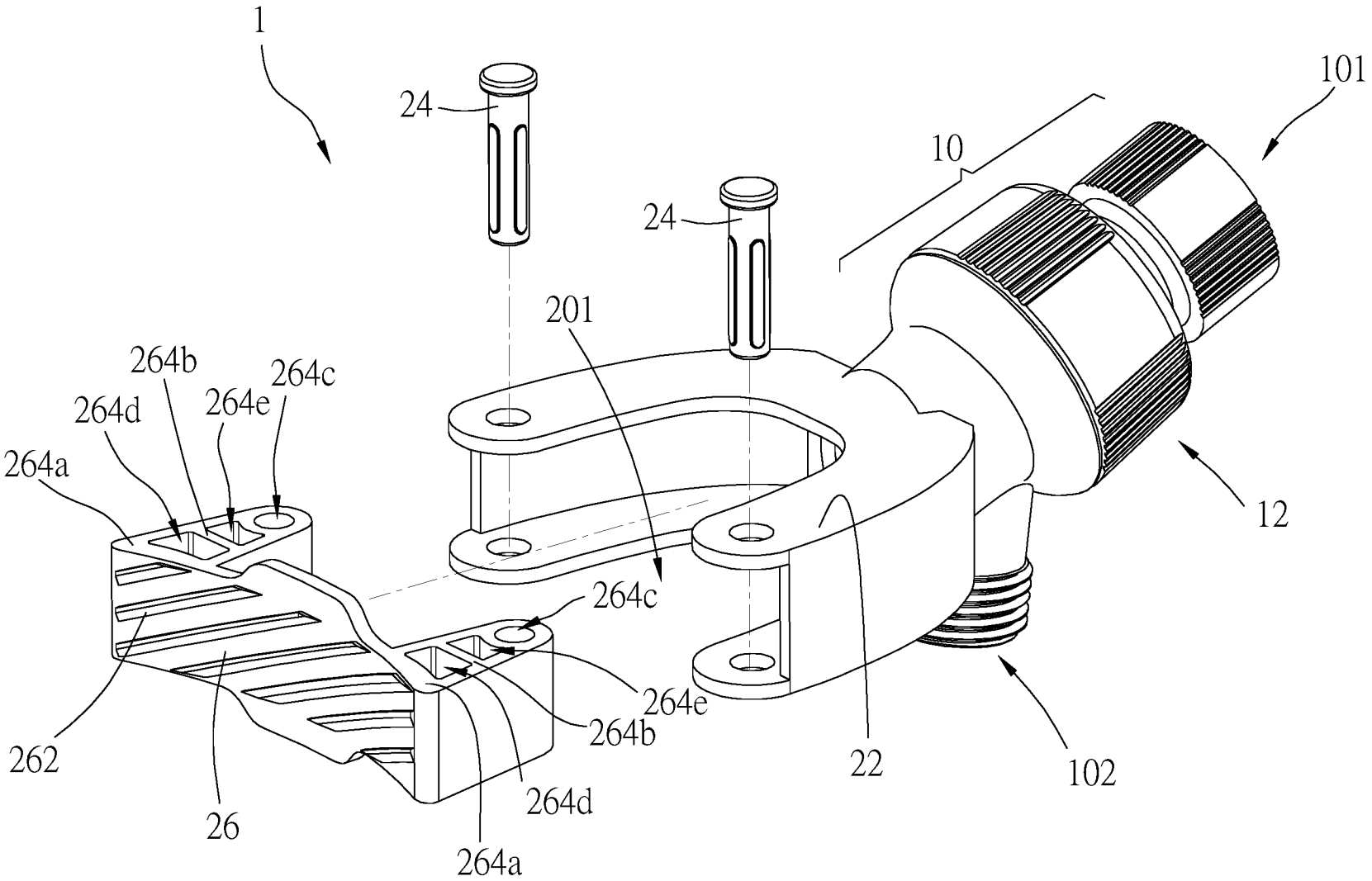
FIG. 2 is a partial exploded view of the bracket according to one embodiment of the present invention.

As illustrated in FIG. 1 to FIG. 5, a bracket for a hand shower 1 is provided. The bracket for the hand shower 1 includes a pipe 10 and a bracket assembly 20. The pipe 10 includes a pipe body 12, an inlet opening 101 and an outlet opening 102, wherein the inlet opening 101 is at one end 121 of the pipe body 12, while the outlet opening 102 is at another end 122 of the pipe body 12. The inlet opening 101 and the outlet opening 102 communicate with each other.

The bracket assembly 20 is connected to the pipe body 12 of the pipe 10. The bracket assembly 20 includes a main body 22 and a flexible member 26, wherein the main body 22 includes a first arm 221 and a second arm 223. Both of the first arm 221 and the second arm 223 have a connected end 221*b*, 223*b* and a pivoted end 221*a*, 223*a*, wherein the connected end 221*b* of the first arm 221 is connected to the connected end 223*b* of the second arm 223, and the pivoted end 221*a* of the first arm 221 is separated from the pivoted end 223*a* of the second arm 223, so as to compose a recess 201.

The flexible member 26 includes a girdle portion 266, a first pivoting portion 261 and a second pivoting portion 263, wherein one end of the girdle portion 266 is connected to the first pivoting portion 261, while another end of the girdle portion 266 is connected to the second pivoting portion 263. The first pivoting portion 261 of the flexible member 26 is pivotably connected to the pivoted end 221*a* of the first arm 221, while the second pivoting portion 263 of the flexible member 26 is pivotably connected to the pivoted end 223*a* of the second arm 223.

When the hand shower O is positioned on the bracket 1, one part of the hand shower O is girdled by the girdle portion 266 of the flexible member 26, and the first pivoting portion 261 and the second pivoting portion 263 of the flexible member 26 are pivoted toward the recess 201, whereby to move the hand shower O toward the recess 201, so that the hand shower O is girdled by the bracket assembly 20.

When the hand shower O is moved away from the bracket 1, the hand shower O is moved away from the recess 201, whereby to pivot the first pivoting portion 261 and the second pivoting portion 263 of the flexible member 26 away from the recess 201, so that the hand shower O is not girdled by the girdle portion 266 of the flexible member 26.

The bracket assembly 20 includes two pins 24, the first pivoting portion 261 of the flexible member 26 is pivotably connected to the pivoted end 221*a* of the first arm 221 by one of the pins 24, while the second pivoting portion 263 of the flexible member 26 is pivotably connected to the pivoted end 223*a* of the second arm 223 by the other one of the pins 24.

Each of the first pivoting portion 261 and the second pivoting portion 263 includes, but not limited thereto, a first rib 264*a*, a second rib 264*b* and a pin hole 264*c*, wherein the second rib 264*b* is located between the first rib 264*a* and the pin hole 264*c*, and a bore 264*d* is between the first rib 264*a* and the second rib 264*b*, and another bore 264*e* is between the second rib 264*b* and the pin hole 264*c*. According to one embodiment of the present invention, the length of the first rib 264*a* is greater than the length of the second rib 264*b*. According to one embodiment of the present invention, the end of the girdle portion 266 connected to the first pivoting portion 261 is connected to the first rib 264*a* of the first pivoting portion 261. According to one embodiment of the present invention, the end of the girdle portion 266 connected to the second pivoting portion 263 is connected to the first rib 264*a* of the second pivoting portion 263. According to one embodiment of the present invention, each of the first pivoting portion 261 and the second pivoting portion 263 could further include a lateral rib connected to the first rib 264*a* and the second rib 264*b*. According to one embodiment of the present invention, the first rib 264*a* and the second rib 264*b* could respectively have a wave-like shape, but not limited thereto. According to one embodiment of the present invention, each of the first pivoting portion 261 and the second pivoting portion 263 could further include a recess or a hole positioned between the first rib 264*a* and the second rib 264*b*, in order to increase an elastic property of each of the first pivoting portion 261 and the second pivoting portion 263, to prevent from shrinking, and to decrease the use of material to form the first pivoting portion 261 and the second pivoting portion 263.

Figure 3:
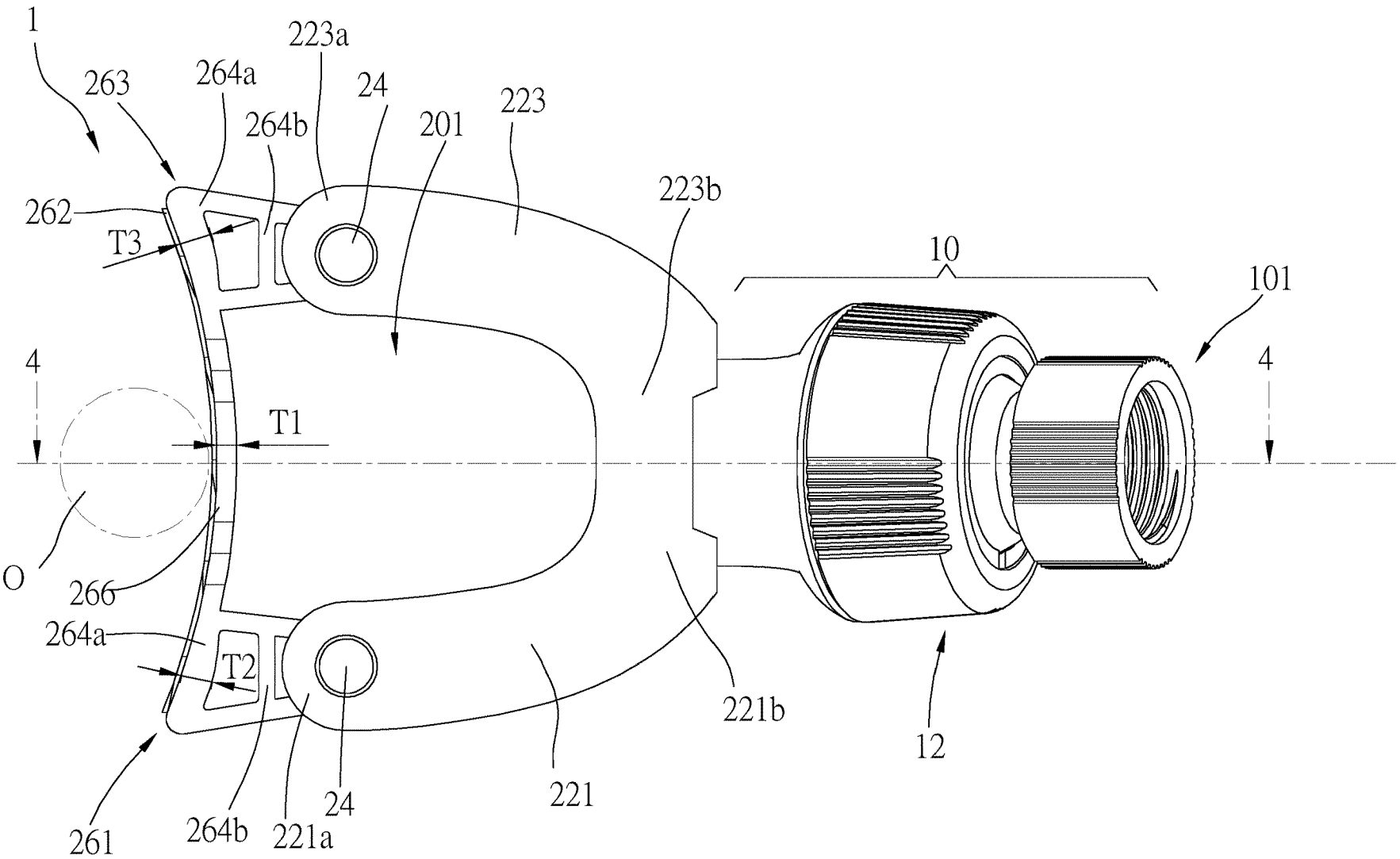
FIG. 3 is a top view of the bracket according to one embodiment of the present invention.

Referring to FIG. 3, the girdle portion 266 has a thickness T1, and the first rib 264*a* of the first pivoting portion 261 has a thickness T2. According to one embodiment of the present invention, the thickness T1 of the girdle portion 266 is less than the thickness T2 of the first rib 264*a* of the first pivoting portion 261.

As shown in FIG. 3, the first rib 264*a* of the second pivoting portion 263 has a thickness T3. According to one embodiment of the present invention, the thickness T1 of the girdle portion 266 is less than the thickness T3 of the first rib 264*a* of the second pivoting portion 263.

Furthermore, in FIG. 3, the flexible member 26 includes a friction surface 262, the friction surface 262 is located at the girdle portion 266, whereby to increase a friction between the girdle portion 266 and the hand shower O. According to one embodiment of the present invention, the friction surface 262 is located at the girdle portion 266 and the first rib 264*a* of the first pivoting portion 261. According to another one embodiment of the present invention, the friction surface 262 is located at the girdle portion 266, the first rib 264*a* of the first pivoting portion 261 and the first rib 264*a* of the second pivoting portion 263.

Referring to FIG. 1, the girdle portion 266 has a first width W1 at two portions thereof respectively connected to the first pivoting portion 261 and the second pivoting portion 263. The girdle portion 266 has a second width W2 at a central portion thereof. According to one embodiment of the present invention, the second width W2 is greater than the first width W1. According to embodiments of the present invention, the girdle portion 266 has a central portion having two sides being perpendicular to a direction of the flexible member 26 moving into the recess 201, and at least one of the two sides of the central portion of the girdle portion 266 protrudes in a direction perpendicular to the direction of the flexible member 26 moving into the recess 201, whereby to prevent a handle of hand shower O from being damaged by directly contacting to the main body 22 of the bracket assembly 20. According to embodiments of the present invention, the two sides of the central portion of the girdle portion 266 protrude in two opposite directions perpendicular to the direction of the flexible member 26 moving into the recess 201, as shown in FIG. 1.

Figure 5:
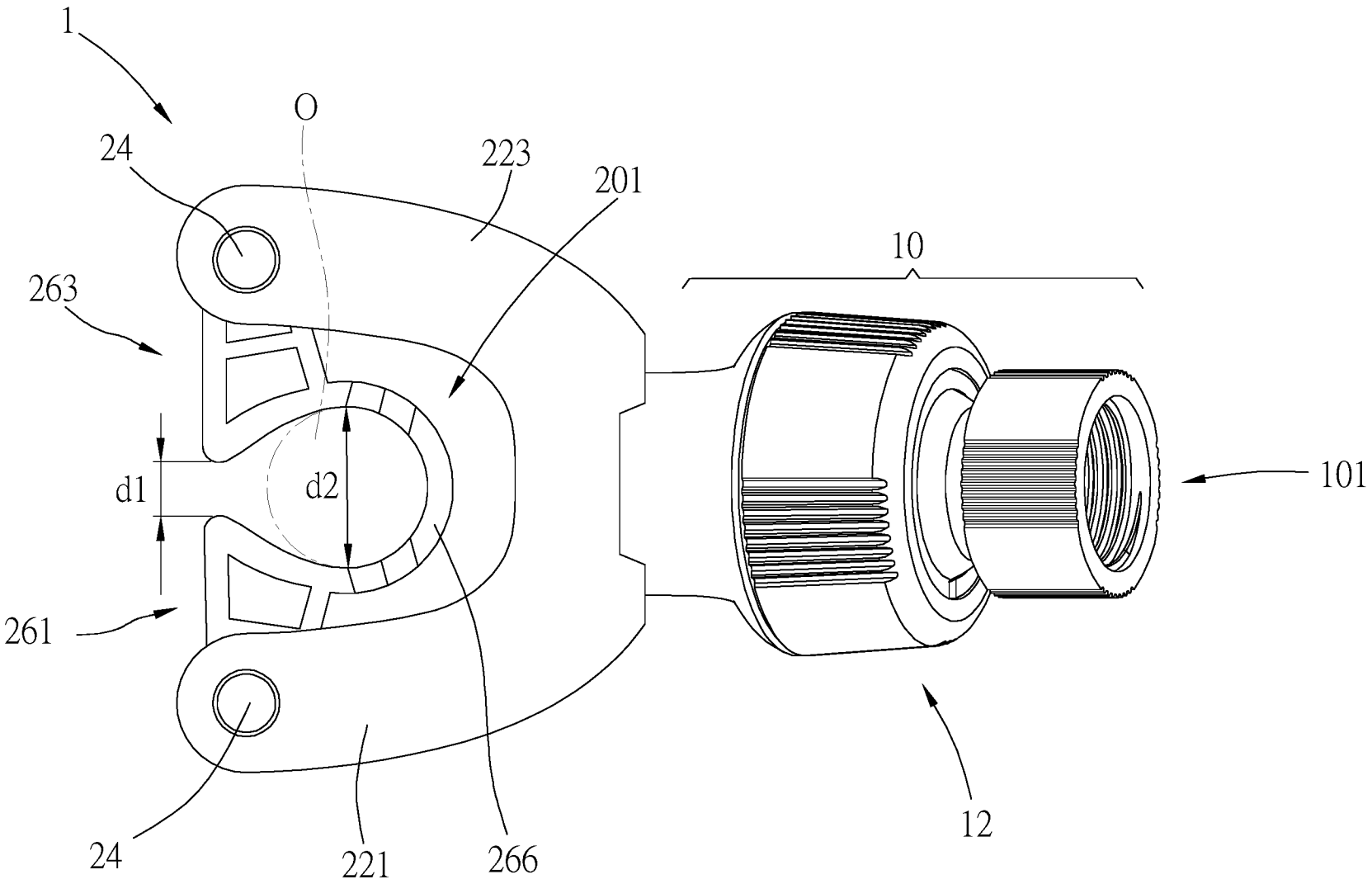
FIG. 5 is another top view of a combination of the bracket and a handle of the hand shower according to one embodiment of the present invention.
Figure 6:
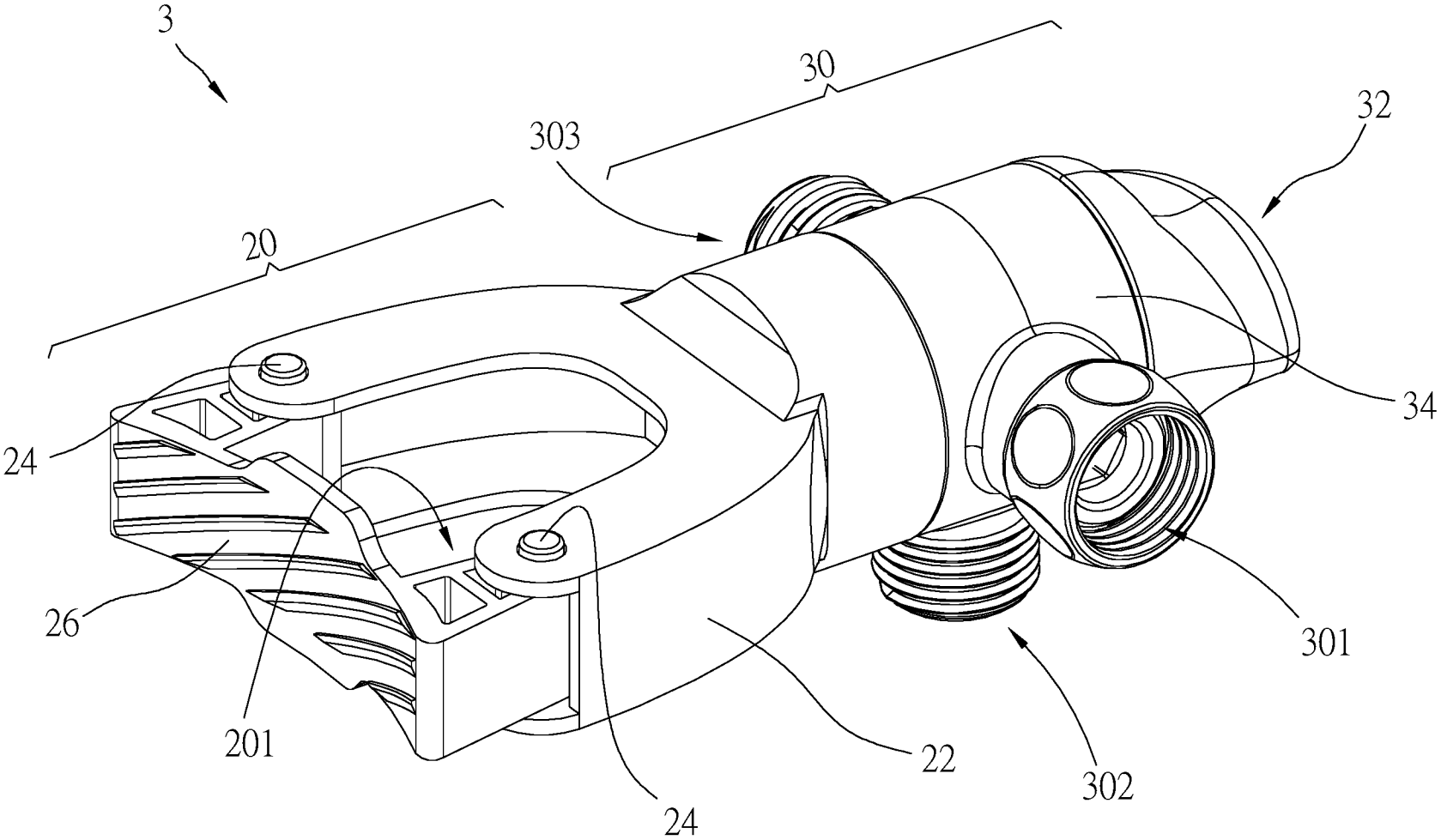
FIG. 6 is a perspective view of a bracket for a hand shower according to another one embodiment of the present invention.

Referring to FIG. 3 and FIG. 5, when the hand shower O is moved away from the bracket 1, and the hand shower O is not girdled by the girdle portion 266 of the flexible member 26, the girdle portion 266 of the flexible member 26 has a first length. When the hand shower O is positioned on the bracket 1, and the hand shower O is girdled by the girdle portion 266 of the flexible member 26, the girdle portion 266 of the flexible member 26 has a second length. According to one embodiment of the present invention, the second length is greater than the first length.

As shown in FIG. 5, when the hand shower O is positioned on the bracket 1, and the hand shower O is girdled by the girdle portion 266 of the flexible member 26, a gap d1 is between the first pivoting portion 261 and the second pivoting portion 263. According to one embodiment of the present invention, when the hand shower O is positioned on the bracket 1, and the hand shower O is girdled by the girdle portion 266 of the flexible member 26, a least distance d1 between the first pivoting portion 261 and the second pivoting portion 263 is less than an outer diameter d2 of the hand shower O.

Figure 4:
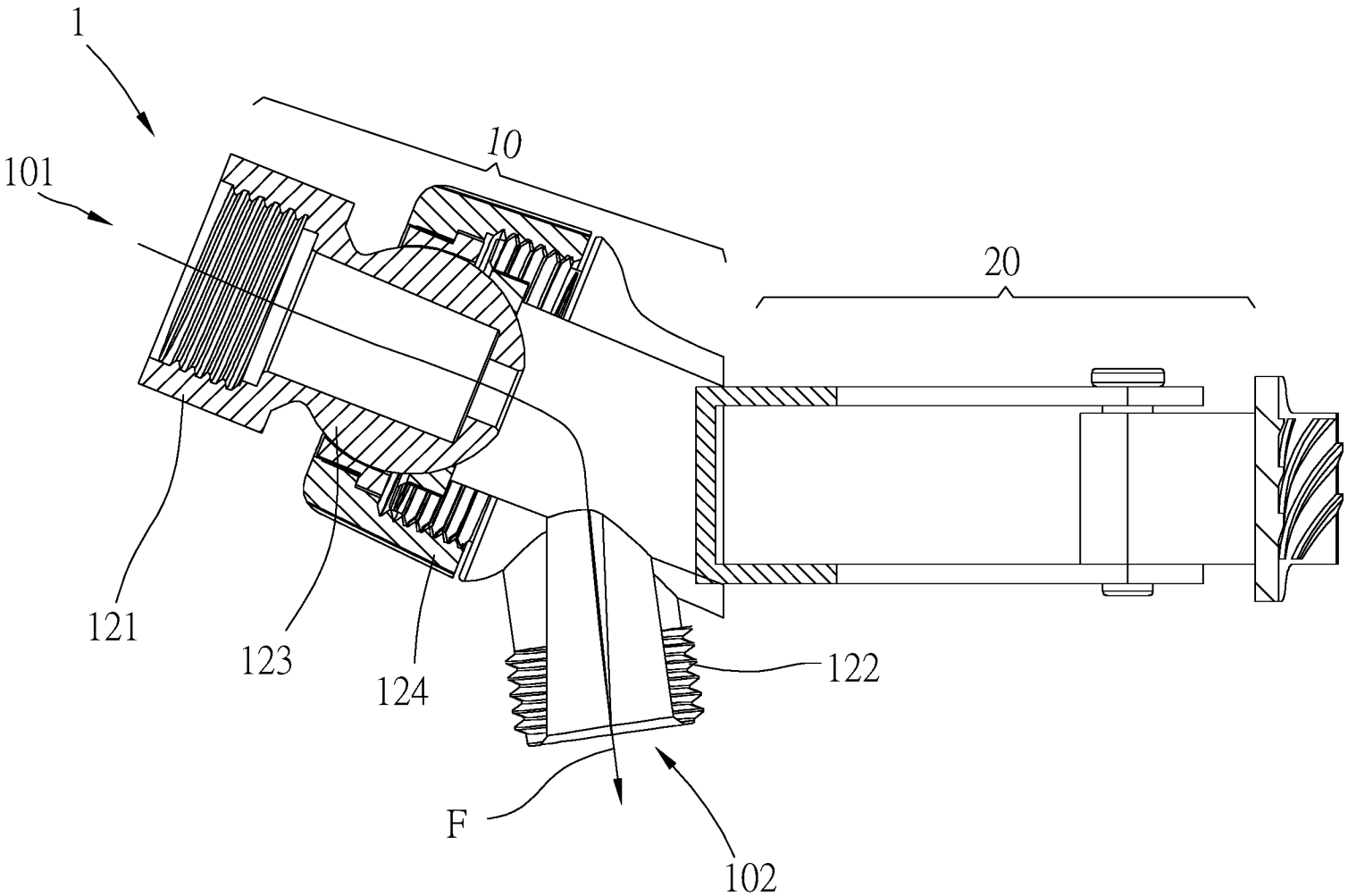
FIG. 4 is a cross-sectional view of the bracket according to one embodiment of the present invention.

Referring to FIG. 4, the pipe 10 has a universal joint 123, the universal joint 123 is located between the inlet opening 101 and the outlet opening 102. According to one embodiment of the present invention, the universal joint 123 communicates with the inlet opening 101 and the outlet opening 102, whereby water F could flow from the inlet opening 101 to the outlet opening 102, through the universal joint 123. In FIG. 4, the pipe body 12 includes a hollow cap 124 which is adapted to fix a position of the universal joint 123. According to one embodiment of the present invention, the outlet opening 102 is adapted to connect to the hand shower O through a communication tube (not shown).

Figure 7:
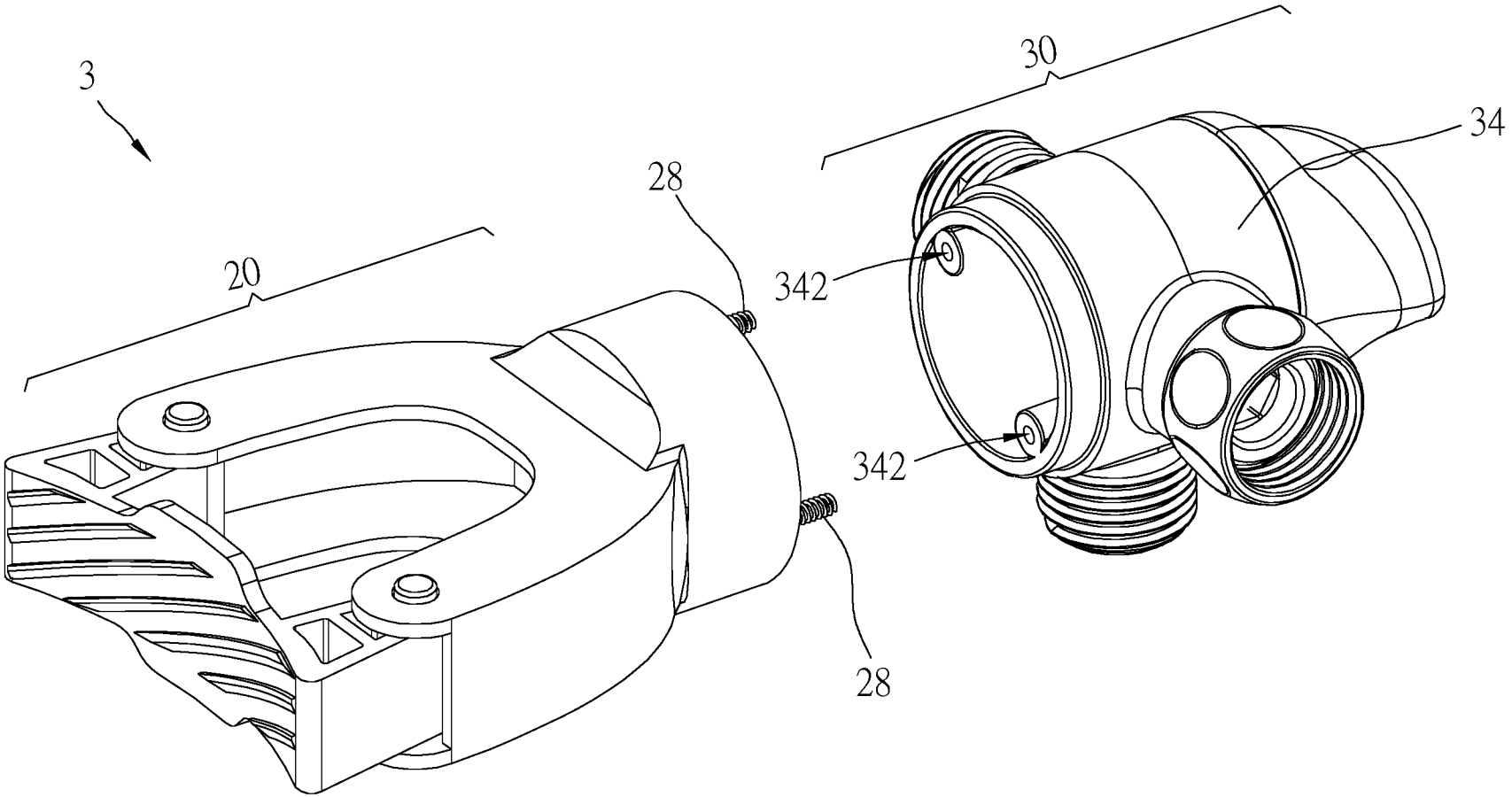
FIG. 7 is a partial exploded view of FIG. 6.

As illustrated in FIG. 6 to FIG. 11, a bracket 3 for a hand shower is provided. The bracket 3 for the hand shower includes a pipe 30 and a bracket assembly 20. In the present embodiment, the pipe 30 and the bracket assembly 20 are detachably connected to each other, as shown in FIG. 7.

In the present embodiment, the pipe 30 is a T-joint pipe which includes a rotatable member 32, a pipe body 34, an inlet opening 301, a first outlet opening 302 and a second outlet opening 303 wherein the inlet opening 301, the first outlet opening 302 and the second outlet opening 303 are positioned on the pipe body 30. In FIG. 7, the bracket assembly 20 has two screws 28, and the pipe body 34 has two screwed holes 342, wherein one of the two screws 28 could be connected to one of the two screwed holes 342, while the other one of the two screws 28 could be connected to the other one of the two screwed holes 342, whereby to connect the bracket assembly 20 to the pipe body 34.

The inlet opening 301 and the first outlet opening 302 and the second outlet opening 303 communicate with each other. The inlet opening 301, the first outlet opening 302 and the second outlet opening 303 communicate with each other, wherein the inlet opening 301 and the first outlet opening 302 form a first flow way F1 in the pipe body 34, while the inlet opening 301 and the second outlet opening 303 form a second flow way F2 in the pipe body 34.

The rotatable member 32 is connected to the pipe body 34, and the rotatable member 32 could be operated to rotate relative to the pipe body 34. When the rotatable member 32 stays at one of the outlet mode positions, only one outlet opening is open, and the other outlet opening is blocked by the rotatable member 32.

Figure 8:
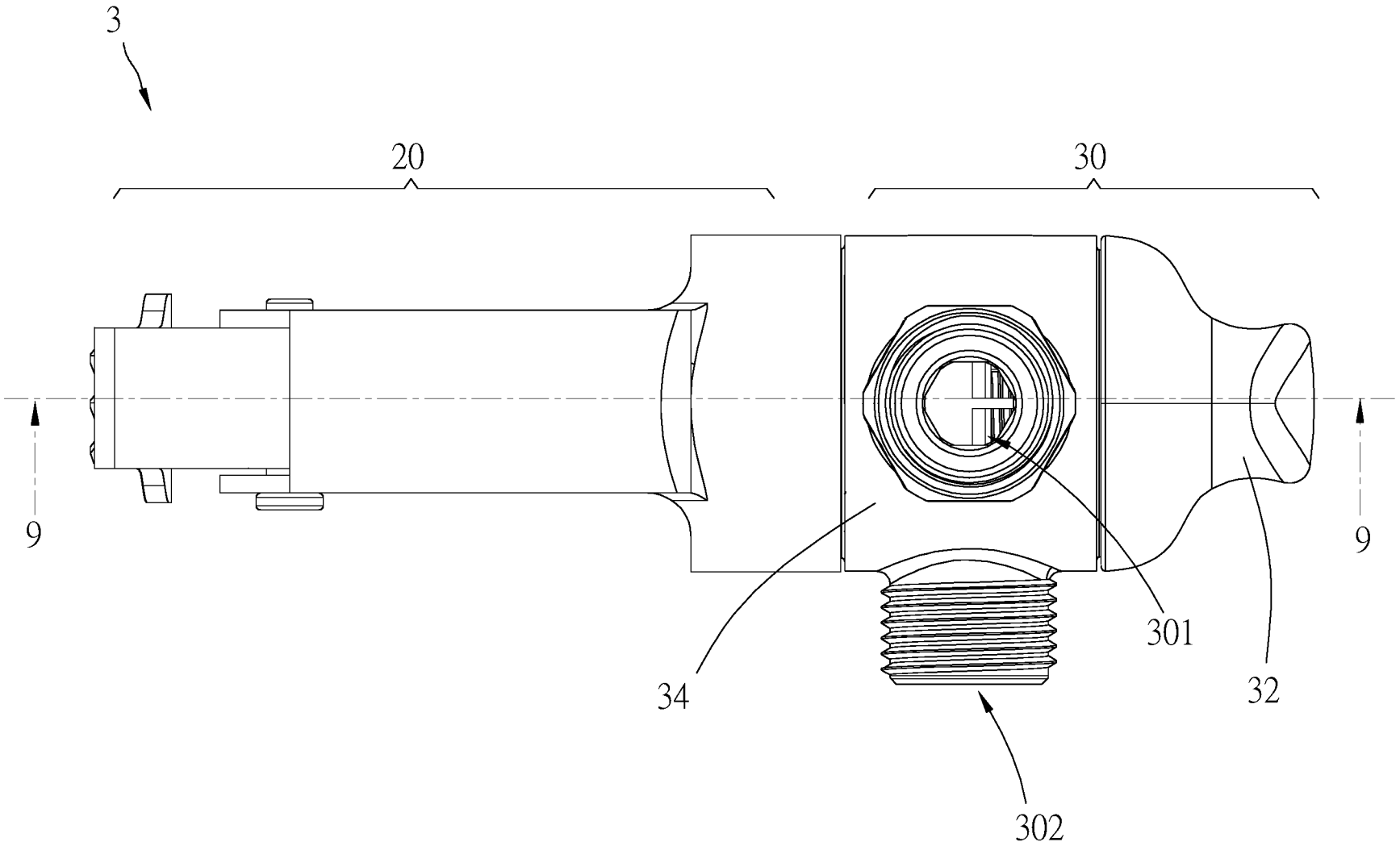
FIG. 8 is a side view of the bracket in FIG. 6.
Figure 9:
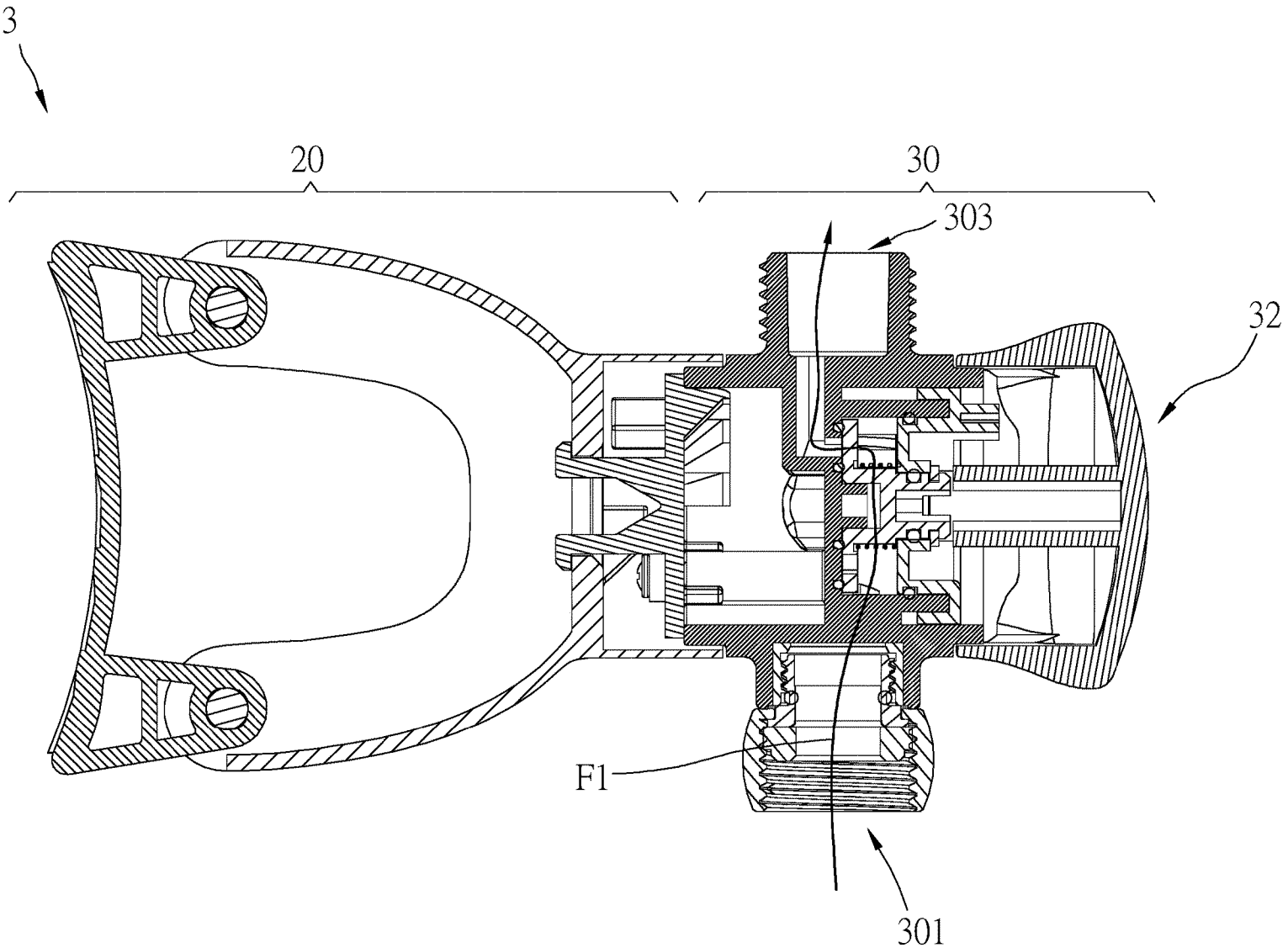
FIG. 9 is a cross-sectional view of FIG. 8.

For example, in FIG. 8 and FIG. 9, when the rotatable member 20 stays at a first one of the outlet mode positions, only the outlet opening 302 is open, and the outlet opening 303 is blocked by the rotatable member 32, whereby water could flow through the first flow way F1 to outlet from the outlet opening 302.

Figure 10:
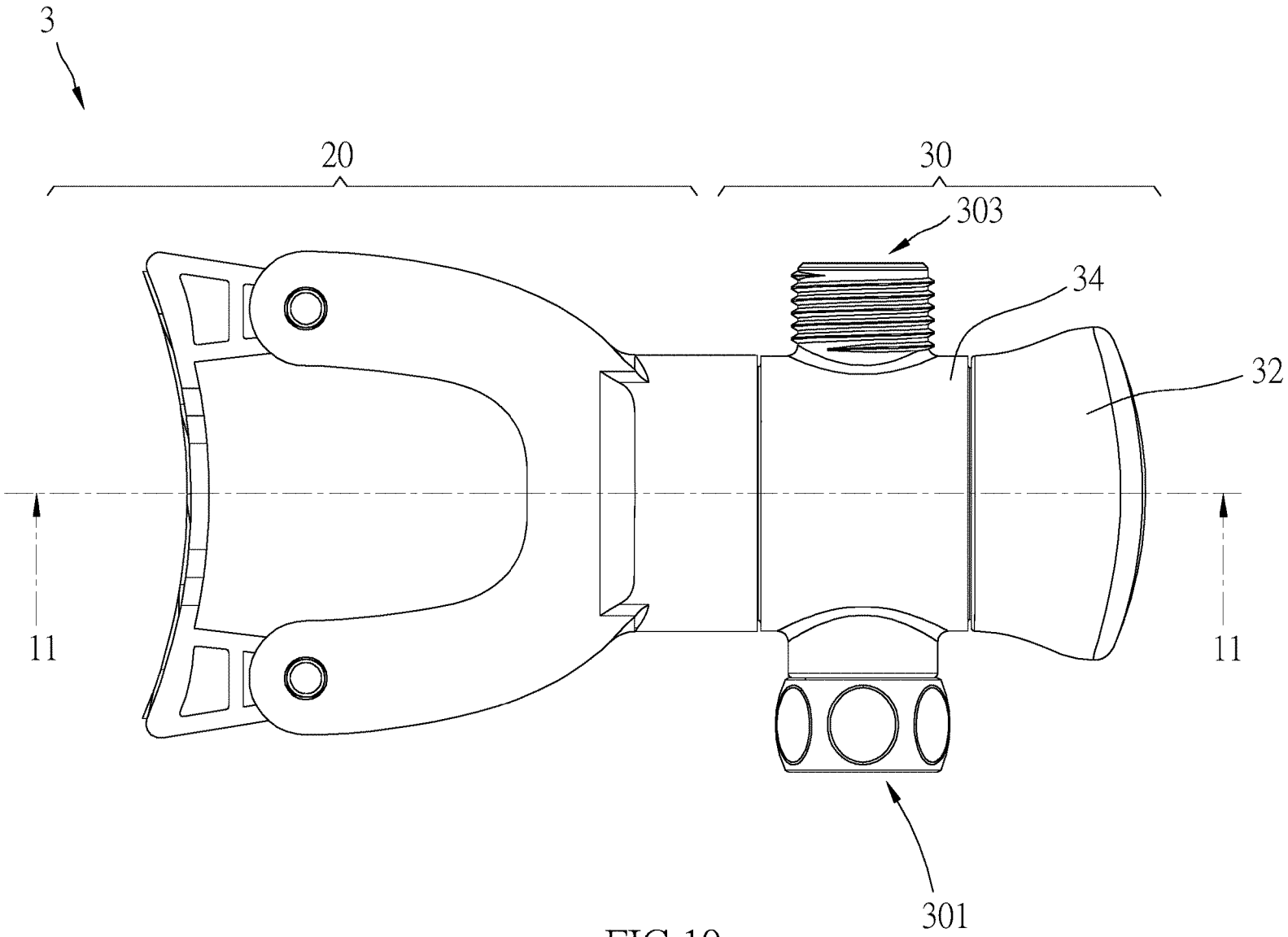
FIG. 10 is a top view of the bracket in FIG. 6.
Figure 11:
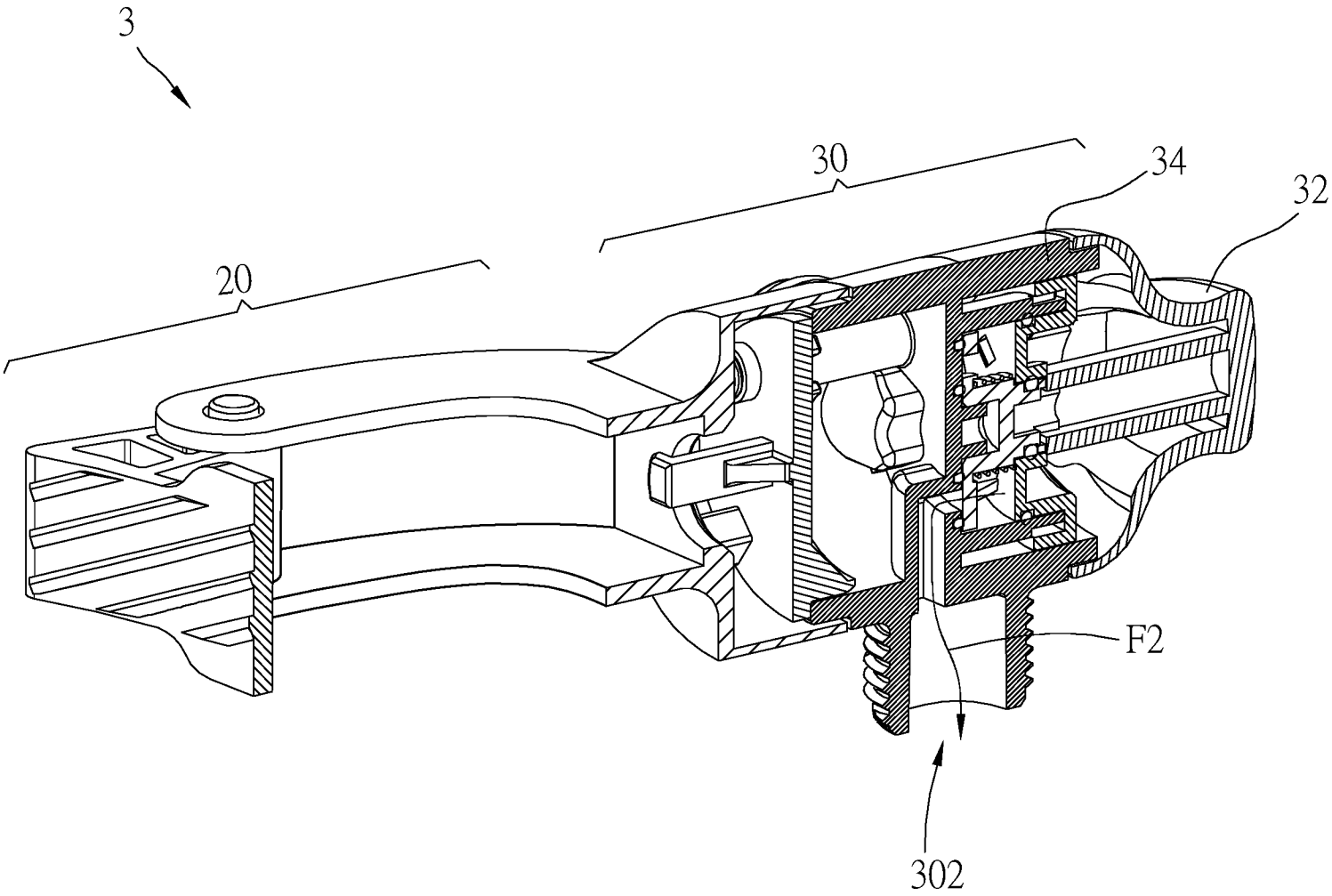
FIG. 11 is a cross-sectional view of FIG. 10.

In FIG. 10 and FIG. 11, when the rotatable member 20 stays at a second one of the outlet mode positions, only the outlet opening 303 is open, and the outlet opening 302 is blocked by the rotatable member 32, whereby water could flow through the second flow way F2 to outlet from the outlet opening 303.

With the aforementioned design, since a hand shower could be taken from and put into the bracket in a forward direction or a backward direction, the bracket provided in the present invention is more convenient to use. Furthermore, the bracket provided in the present is adapted to hold various sizes of hand showers, for the bracket includes the girdle portion of the flexible member, which could be adapted to girdled a handle of the hand shower, when the hand shower is positioned on the bracket.

It must be pointed out that the embodiments described above are only some preferred embodiments of the present invention. All equivalent structures which employ the concepts disclosed in this specification and the appended claims should fall within the scope of the present invention.

What is claimed is:

1. A bracket for a hand shower, comprising:

a pipe having a pipe body, an inlet opening and an outlet opening, the inlet opening being at one end of the pipe body, the outlet opening being at another end of the pipe body, the inlet opening and the outlet opening communicating with each other; and a bracket assembly connected to the pipe body of the pipe, the bracket assembly comprising a main body and a flexible member, the main body comprising a first arm, a second arm, and a recess formed by the first arm and the second arm, both of the first arm and the second arm having a connected end and a pivoted end, the connected end of the first arm being connected to the connected end of the second arm, the pivoted end of the first arm being separated from the pivoted end of the second arm the flexible member comprising a girdle portion, a first pivoting portion and a second pivoting portion, one end of the girdle portion being connected to the first pivoting portion, another end of the girdle portion being connected to the second pivoting portion the first pivoting portion of the flexible member being pivotably connected to the pivoted end of the first arm, the second pivoting portion of the flexible member being pivotably connected to the pivoted end of the second arm;

when the hand shower is positioned on the bracket, one part of the hand shower being girdled by the girdle portion of the flexible member, the first pivoting portion and the second pivoting portion of the flexible member being pivoted toward the recess, thereby moving the hand shower toward the recess to girdle the hand shower by the bracket assembly;

when the hand shower is moved away from the bracket, the hand shower being moved away from the recess, thereby pivoting the first pivoting portion and the second pivoting portion of the flexible member away from the recess to not girdle the hand shower by the girdle portion of the flexible member.

2. The bracket of claim 1, wherein the bracket assembly comprises two pins, the first pivoting portion of the flexible member being pivotably connected to the pivoted end of the first arm by one of the pins, the second pivoting portion of the flexible member being pivotably connected to the pivoted end of the second arm by the other one of the pins.

3. The bracket of claim 2, wherein each of the first pivoting portion and the second pivoting portion comprises at least one rib.

4. The bracket of claim 3, wherein the end of the girdle portion connected to the first pivoting portion connects to the at least one rib of the first pivoting portion.

5. The bracket of claim 3, wherein the end of the girdle portion connected to the second pivoting portion connects to the at least one rib of the second pivoting portion.

6. The bracket of claim 1, wherein the flexible member comprises a friction surface, the friction surface being located at the girdle portion.

7. The bracket of claim 6, wherein the friction surface is located at the girdle portion and the first rib of the first pivoting portion.

8. The bracket of claim 7, wherein the friction surface is located at the girdle portion, the first rib of the first pivoting portion and the first rib of the second pivoting portion.

9. The bracket of claim 1, wherein the girdle portion has a central portion having two sides being perpendicular to a direction of the flexible member moving into the recess, and at least one of the two sides of the central portion of the girdle portion protrudes in a direction perpendicular to the direction of the flexible member moving into the recess.

10. The bracket of claim 1, wherein the girdle portion of the flexible member has a first length when the hand shower is moved away from the bracket and the hand shower is not girdled by the girdle portion of the flexible member; the girdle portion of the flexible member has a second length; the second length is greater than the first length when the hand shower is positioned on the bracket and the hand shower is girdled by the girdle portion of the flexible member.

11. The bracket of claim 1, wherein a gap is between the first pivoting portion and the second pivoting portion when the hand shower is positioned on the bracket and the hand shower is girdled by the girdle portion of the flexible member.

12. The bracket of claim 1, wherein a least distance between the first pivoting portion and the second pivoting portion is less than an outer diameter of the hand shower when the hand shower is positioned on the bracket and the hand shower is girdled by the girdle portion of the flexible member.

13. The bracket of claim 1, wherein the pipe has a universal joint, the universal joint being located between the inlet opening and the outlet opening.

14. The bracket of claim 13, wherein the universal joint communicates with the inlet opening and the outlet opening.

15. The bracket of claim 1, wherein the outlet opening is adapted to connect to the hand shower.

16. The bracket of claim 1, wherein the pipe includes a rotatable member, the pipe body, the inlet opening and the outlet opening; the outlet opening comprising a first outlet opening and a second outlet opening; the inlet opening, the first outlet opening and the second outlet opening being positioned on the pipe body; the inlet opening and the first outlet opening and the second outlet opening communicating with each other; the inlet opening, the first outlet opening and the second outlet opening communicating with each other, the inlet opening and the first outlet opening forming a first flow way in the pipe body, the inlet opening and the second outlet opening forming a second flow way in the pipe body; the rotatable member being connected to the pipe body, and the rotatable member being operable to rotate relative to the pipe body; when the rotatable member stays at one of outlet mode positions, only one outlet opening being open, and the other outlet opening being blocked by the rotatable member, thereby flowing water through the first flow way or the second flow way to outlet from the first outlet opening or the second outlet opening.

* * * * *